US006986640B2

(12) United States Patent
Laing

(10) Patent No.: US 6,986,640 B2
(45) Date of Patent: Jan. 17, 2006

(54) MOTOR PUMP WITH EXPANSION TANK

(75) Inventor: Karsten A. Laing, La Jolla, CA (US)

(73) Assignees: Oliver Laing (DE); Karsten Laing (DE); Birger Laing (DE)

( * ) Notice: Subject to any disclaimer, the term of this patent is extended or adjusted under 35 U.S.C. 154(b) by 92 days.

(21) Appl. No.: 10/152,266

(22) Filed: May 20, 2002

(65) Prior Publication Data

US 2003/0215327 A1 Nov. 20, 2003

(51) Int. Cl.
*F04D 29/40* (2006.01)

(52) U.S. Cl. ..... 415/126

(58) Field of Classification Search ..... 415/126, 415/127, 128

See application file for complete search history.

(56) References Cited

U.S. PATENT DOCUMENTS

| | | | | | |
|---|---|---|---|---|---|
| 3,591,079 A | * | 7/1971 | Peters | 237/8 A |
| RE30,334 E | * | 7/1980 | Coles | 74/18.1 |
| 4,488,856 A | * | 12/1984 | Preble et al. | 417/409 |
| 4,658,166 A | | 4/1987 | Oudet | |
| 4,682,067 A | | 7/1987 | Oudet | |
| 4,866,323 A | | 9/1989 | Oudet et al. | |
| 5,237,309 A | * | 8/1993 | Frantz et al. | 340/679 |
| 5,797,430 A | * | 8/1998 | Becke et al. | 138/30 |
| 5,993,170 A | * | 11/1999 | Stevens et al. | 417/244 |
| 6,074,092 A | * | 6/2000 | Andrews | 378/200 |

FOREIGN PATENT DOCUMENTS

| | | |
|---|---|---|
| DE | 45808 | 6/1887 |
| DE | 78075 | 5/1893 |

OTHER PUBLICATIONS

Minimotor SA Product Design Web Page Mar. 2, 2002 Minimotro SA, Switzerland.

The New Quantum Leap in Motor Technology: "Ferrous Loss–Free".

* cited by examiner

*Primary Examiner*—Ninh H. Nguyen
(74) *Attorney, Agent, or Firm*—Foley & Lardner LLP

(57) ABSTRACT

A pump particularly adapted for use in a closed fluid circuit, as within its housing a resiliently compressible chamber in contact with the fluid being conveyed by the pump so that any pressure change within the fluid caused by temperature variations can be volumetrically absorbed by compression or extension of the chamber.

11 Claims, 2 Drawing Sheets

MOTOR PUMP WITH EXPANSION TANK

FIELD OF THE INVENTION

This invention relates to pumps and more particularly to pumps used as part of a closed fluid circuit.

BACKGROUND OF THE INVENTION

When a fluid is circulated through a closed circuit by means of a pump, it is often necessary to provide a structure or mechanism to accommodate expansion or contraction of the conveyed fluid due to change in temperature which are sufficient to affect the volume of the fluid itself or the capacity of certain components in the circuit.

SUMMARY OF THE INVENTION

The principal and secondary objects of this invention are to provide a convenient mechanism within a pump to accommodate volumetric variation in the conveyed fluid or other components of a closed fluid circuit and avoid the necessity of providing a structure or mechanism along the fluid circuit to compensate for those variations often caused by change in ambient or internal temperature.

These and other objects are achieve by providing within the housing of the pump, a resiliently compressible chamber formed in part by a flexible membrane, which chamber is in contact with, but not accessible to the fluid being conveyed by the pump.

DESCRIPTION OF THE PREFERRED EMBODIMENTS OF THE INVENTION

Figure 1:
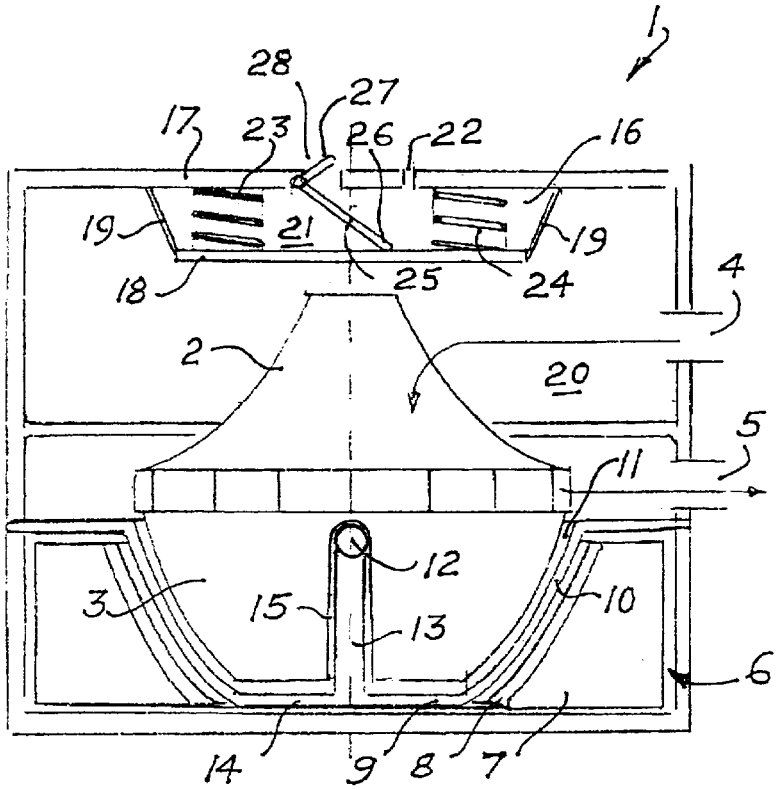
FIG. 1 is a first embodiment of a pump with resiliently compressible internal chamber according to the invention.

Referring now to the drawing, there is shown in FIG. 1, a spherical pump 1 in which the impeller 2 is secured to the top surface of a hemispherical rotor 3 preferably comprising a permanent magnet. Fluid entering the pump through the inlet 4 is centrifugally directed toward an outlet 5. An annular stator 6 comprising a soft magnetic yoke 7 and a winding 8 applied to the inner surface of the yoke is separated from the fluid by a watertight septum 9 having a annular portion 10 extending into the air gap 11 between the rotor and the stator. The rotor is immersed in the fluid and supported by a single-ball bearing mounted at the end of a shaft 13 projecting from a medium flat section 14 of the septum, and into an axial cavity 15 in the lower portion of the rotor.

A resiliently compressible chamber 16 is positioned against the inside surface of the top wall 17 of the pump enclosure. The chamber comprises a rigid member 18 substantially parallel to the top wall 17 and a circular flexible membrane 19 extending between the periphery of the rigid member 18 and the inside surface of the top wall 17 to form a chamber which is in contact with a fluid-holding area 20 of the pump housing but whose inside 21 is not accessible to the conveyed fluid. An aperture 22 in the inside portion of the wall 17 puts the interior of the chamber in communication with ambient air outside the pump. A series of coil springs 23, 24 are compressed between the rigid member 18 and the top wall 17 of the pump enclosure.

A plunger 25 inside the chamber has a first end connected to the rigid member 18 and an opposite end having a tip protruding through a window 28 in the top wall of the pump enclosure; whereby the position of the tip 27 provides an approximate indication of the degree of compression or expansion of the chamber.

Figure 2:
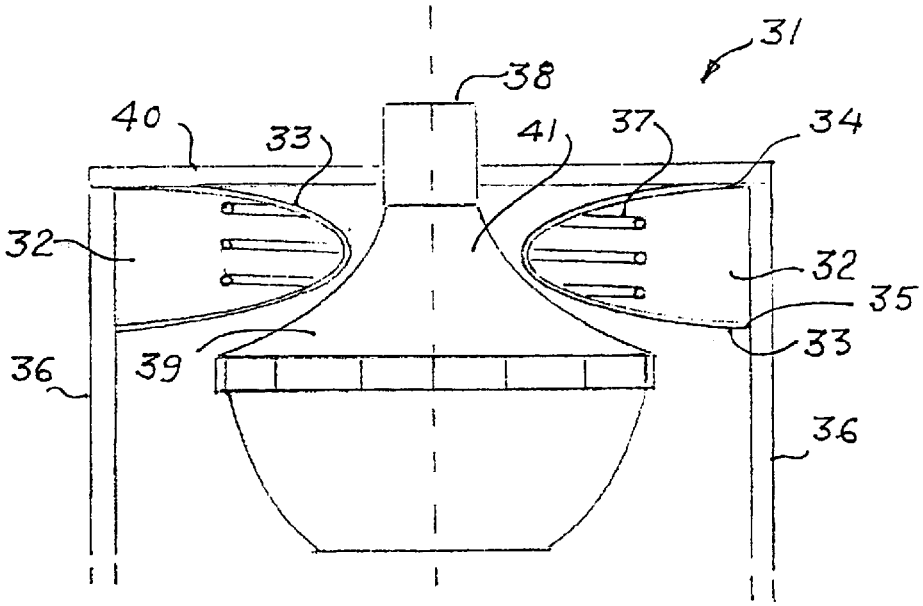
FIG. 2 is a cross-sectional view of a second embodiment of a similar pump.

In the second embodiment of the invention 31 illustrated in FIG. 2, an annular compressible chamber 32 is formed by a pulley-shaped membrane 33 having both rims 34, 35 secured to the inside surface of a lateral wall 36 of the pump housing. A coil spring is coaxially positioned inside the annular chamber 32. In this particular embodiment, the pump inlet is conveniently positioned coaxially and above the impeller and the propeller is positioned proximal, and axially perpendicularly to the top wall 40 of the enclosure. This second embodiment of the invention allows for a more compact pump housing since a top portion 41 of the impeller is surrounded by the resiliently compressible chamber 32 rather than being located below it as described in connection with the first embodiment of the invention.

Figure 3:
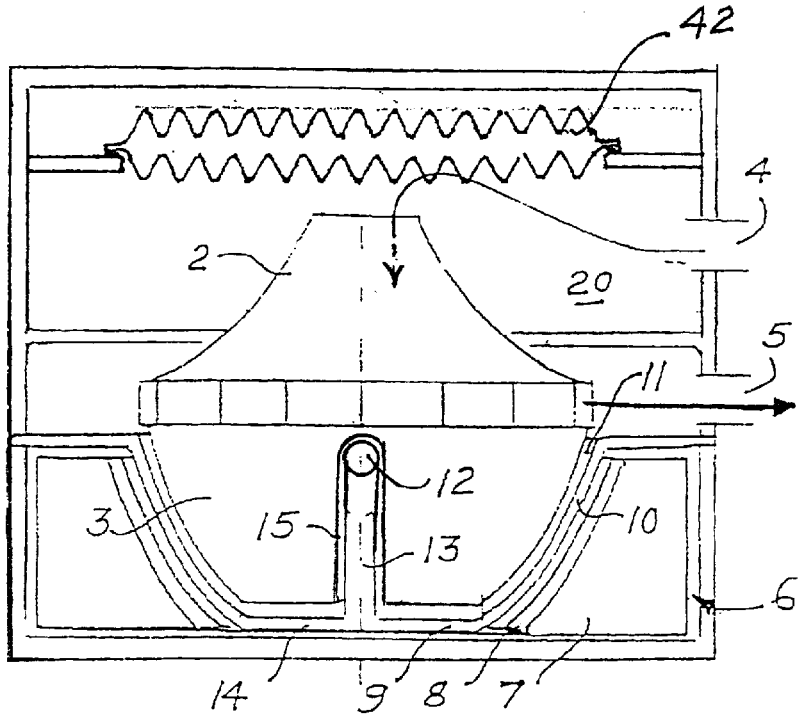
FIG. 3 is a cross-sectional view of a third embodiment of the pump.

In the third embodiment of the invention illustrated in FIG. 3, a simple barometric bellow 42 is used in a pump similar to the one illustrated in FIG. 1 in lieu of the resiliently compressible chamber 16. Such a bellow is commonly found in some types of barometric instruments.

While the preferred embodiments of the invention have been described, modifications can be made and other embodiments may be devised without departing from the spirit of the invention and the scope of the appended claims.

What is claimed is:

1. A pump used for conveying fluid in a closed fluid circuit, said pump comprising:

a housing having a plurality of walls, at least one inlet and at least one separate outlet; and a resiliently compressible chamber within said housing, and in contact with said closed fluid circuit, said compressible chamber having a flexible membrane portion, said flexible membrane portion forming a boundary between said compressible chamber and said closed fluid circuit;

wherein any expansion of said fluid is compensated by a corresponding volumetric compression of said compressible chamber, and wherein said compressible chamber is enclosed so as to be not accessible to said fluid.

2. The pump of claim 1, further comprising: means for resiliently biasing said flexible membrane portion toward a full extension position.

3. The pump of claim 2, wherein the means for resiliently biasing includes a spring element, and wherein the full extension position is based solely on material characteristics of the spring element and the flexible membrane portion.

4. A pump used for conveying fluid in a closed fluid circuit, said pump comprising:

a housing having a plurality of walls; and a resiliently compressible chamber within said housing and in contact with said fluid circuit;

whereby any expansion of said fluid is compensated by a corresponding volumetric compression of said chamber;

wherein said chamber comprises a flexible membrane portion and means for resiliently biasing said membrane portion toward the full extension; and wherein said chamber is not accessible to said fluid and communicates with ambient air through an aperture in said housing.

5. The pump of claim 4, wherein said chamber further comprises a rigid section;

said membrane extends between said rigid number and a portion of one of said walls; and said means for resiliently biasing comprise a coil spring compressibly held between said rigid member and said portion.

6. The pump of claim 5, which further comprises means for indicating a degree of expansion of said chamber.

7. The pump of claim 6, wherein said means for indicating comprises a plunger within said chamber, said plunger being secured to said rigid member and having a tip protruding outside said housing through a hole in said portion.

8. A pump used for conveying fluid in a closed fluid circuit, said pump comprising:

a housing having a plurality of walls; and a resiliently compressible chamber within said housing said in contact with said fluid circuit;

whereby any expansion of said fluid is compensated by a corresponding volumetric compression of said chamber;

wherein said chamber comprises a flexible membrane portion and means for resiliently biasing said membrane portion toward the full extension;

an impeller axially perpendicular to a portion of one of said walls;

said portion having an inlet substantially coaxial with said impeller; and wherein said chamber has an annular shape substantially coaxial with said fluid inlet and impeller.

9. The pump of claim 8, wherein said chamber surrounds a portion of said impeller.

10. The pump of claim 8, wherein said chamber has an outer peripheral portion formed by a section of one of said walls.

11. The pump of claim 8, wherein said means for resiliently biasing comprises a coil spring positioned in said chamber axially with said impeller.

* * * * *